US009753386B2

(12) United States Patent
Nishitera

(10) Patent No.: US 9,753,386 B2
(45) Date of Patent: Sep. 5, 2017

(54) POSITIVELY CHARGEABLE TONER

(71) Applicant: KYOCERA Document Solutions Inc., Osaka (JP)

(72) Inventor: Haruhiro Nishitera, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/197,887

(22) Filed: Jun. 30, 2016

(65) Prior Publication Data

US 2017/0003614 A1 Jan. 5, 2017

(30) Foreign Application Priority Data

Jul. 2, 2015 (JP) ..... 2015-133704

(51) Int. Cl.
*G03G 9/093* (2006.01)
*G03G 9/08* (2006.01)

(52) U.S. Cl.
CPC ..... *G03G 9/0823* (2013.01); *G03G 9/09321* (2013.01)

(58) Field of Classification Search
CPC ..... G03G 9/09307; G03G 9/09314; G03G 9/09321
See application file for complete search history.

(56) References Cited

U.S. PATENT DOCUMENTS 9,023,573 B2 5/2015 Kikushima
2014/0065536 A1 3/2014 Kikushima
2014/0295345 A1* 10/2014 Ojima ..... G03G 9/09392 430/137.11

FOREIGN PATENT DOCUMENTS

JP 59-185353 * 10/1984 ..... G03G 9/08
JP 2014-048501 A 3/2014

OTHER PUBLICATIONS

Translation of JP 59-185353.*

* cited by examiner

*Primary Examiner* — Peter Vajda
(74) *Attorney, Agent, or Firm* — Studebaker & Brackett PC

(57) ABSTRACT

A positively chargeable toner contains plural toner particles each containing a core, and a shell layer disposed over the core. The shell layer contains a first resin containing at least one repeating unit having an amide group, and a second resin containing at least one repeating unit having a quaternary ammonium cation. The toner attains a charge amount $Q_3$ after stirring for 3 minutes and attains a charge amount $Q_{30}$ after stirring for 30 minutes, and "$Q_{30} \leq Q_3$" and "20 $\mu C/g \leq Q_3$" are both satisfied. Assuming that a second mixture of 100 parts by mass of the standard carrier and 10 parts by mass of the toner charged to a saturated charge amount is born on a development roller to measure a charge amount distribution, an arithmetic mean X and a standard deviation Y of the charge amount distribution satisfy "$Y/X \leq 3.5$".

3 Claims, No Drawings

POSITIVELY CHARGEABLE TONER

INCORPORATION BY REFERENCE

The present application claims priority under 35 U.S.C. §119 to Japanese Patent Application No. 2015-133704, filed on Jul. 2, 2015. The contents of this application are incorporated herein by reference in their entirety.

BACKGROUND

The present disclosure relates to a positively chargeable toner, and more particularly, it relates to a capsule toner.

A toner containing, for example, a quaternary ammonium compound as a charge control agent is known.

SUMMARY

A positively chargeable toner contains a plurality of toner particles each containing a core, and a shell layer disposed over a surface of the core. The shell layer contains a first resin and a second resin. The first resin contains at least one repeating unit having an amide group. The second resin contains at least one repeating unit having a quaternary ammonium cation. In a case where a first mixture of 100 parts by mass of a standard carrier and 10 parts by mass of the toner is stirred under an environment of a temperature of 23° C. and a humidity of 60% RH using a shaker mixer, the toner attains, in the first mixture, a charge amount $Q_3$ after stirring for 3 minutes and attains a charge amount $Q_{30}$ after stirring for 30 minutes, and both relationships of "$Q_{30} \leq Q_3$" and "20 μC/g≤$Q_3$" are satisfied. In a case where a second mixture of 100 parts by mass of the standard carrier and 10 parts by mass of the toner having been charged to a saturated charge amount is born on a development roller to measure a charge amount distribution of the toner in the second mixture, an arithmetic mean X and a standard deviation Y of the charge amount distribution satisfy a relationship of "Y/X≤5 3.5".

DETAILED DESCRIPTION

A preferred embodiment of the present disclosure will now be described in detail. A toner according to the present embodiment is a positively chargeable toner and can be suitably used in development of an electrostatic latent image. The toner of the present embodiment is a powder containing a plurality of particles (each having features described later). The toner may be used as a one-component developer. Alternatively, the toner may be mixed with a carrier using a mixer (such as a ball mill) to prepare a two-component developer. In order to form high-quality images, a ferrite carrier is preferably used as the carrier. Besides, in order to form high-quality images over a long period of time, magnetic carrier particles each containing a carrier core, and a resin layer coating the carrier core are preferably used. In order to magnetize the carrier particles, the carrier core may be made of a magnetic material, or magnetic particles may be dispersed in the resin layer. In order to form high-quality images, the content of the toner in the two-component developer is preferably 5 parts by mass or more and 15 parts by mass or less, and more preferably 8 parts by mass or more and 12 parts by mass or less based on 100 parts by mass of the carrier. Incidentally, a positively chargeable toner contained in a two-component developer is positively charged by friction with a carrier.

Each of the toner particles contained in the toner of the present embodiment contains a core (hereinafter referred to as the toner core), and a shell layer (a capsule layer) formed on the surface of the toner core. The shell layer is disposed over the surface of the toner core. The shell layer may be entirely disposed over the surface of the toner core, or partially disposed over the surface of the toner core. An external additive may adhere to the surface of the toner core or the shell layer. Besides, a plurality of shell layers may be stacked on the surface of the toner core. The external additive may be omitted if not necessary. Hereinafter, a toner particle obtained before causing an external additive to adhere thereto will be designated as a toner mother particle. Besides, a material used for forming a shell layer will be designated as a shell material.

The toner of the present embodiment can be used for forming an image in, for example, an electrophotographic apparatus (an image forming apparatus). An example of an image forming method employed by an electrophotographic apparatus will now be described.

First, an electrostatic latent image is formed on a photosensitive member (such as a surface layer portion of a photosensitive drum) based on image data. Next, the electrostatic latent image thus formed is developed using a developer containing a toner. In the development process, the toner (that has been charged, for example, by friction with a carrier or a blade) disposed on a development sleeve (corresponding to, for example, a surface layer portion of a development roller of a developing unit) is allowed to adhere to the electrostatic latent image formed on the photosensitive member to form a toner image on the photosensitive member. In a subsequent transfer process, the toner image formed on the photosensitive member is transferred onto an intermediate transfer member (such as a transfer belt), and then, the toner image transferred onto the intermediate transfer member is transferred further to a recording medium (such as paper). Thereafter, the toner is heated to be fixed on the recording medium. As a result, an image is formed on the recording medium. If toner images of, for example, four colors of black, yellow, magenta, and cyan are superimposed, a full-color image can be formed.

The toner of the present embodiment is a positively chargeable toner having the following feature (1):

(1) In a case where a mixture (a first mixture) of 100 parts by mass of a standard carrier and 10 parts by mass of the toner is stirred under an environment of a temperature of 23° C. and a humidity of 60% RH using a shaker mixer, a charge amount of the toner attained after stirring for 3 minutes (hereinafter referred to as a charge amount $Q_3$) is equal to or larger than a charge amount of the toner attained after stirring for 30 minutes (hereinafter referred to as a charge amount $Q_{30}$), and is 20 μC/g or more. In a case where a mixture (a second mixture) of 100 parts by mass of the standard carrier and 10 parts by mass of the toner having been charged to a saturated charge amount is born on a development roller to measure a charge amount distribution of the toner in the second mixture, an arithmetic mean X and a standard deviation Y of the charge amount distribution thus measured satisfy a relationship of "Y/X≤3.5". The charge characteristics of the toner (i.e., the charge amount $Q_3$, the charge amount $Q_{30}$, and the charge amount distribution) are measured by methods employed in examples described later or alternative methods thereof. The charge characteristics of the toner can be controlled by changing the type or the amount of the shell material.

The toner having the above-described feature (1) has the charge amount distribution having a coefficient of variation (namely, Y/X) of 3.5 or less. Besides, in the toner having the feature (1), the charge amount $Q_3$ and the charge amount $Q_{30}$ satisfy the relationship of "$Q_{30} \leq Q_3$". The present inventor has found that fogging is minimally caused if the toner having such charge characteristics (i.e., the charge amount $Q_3$, the charge amount $Q_{30}$, and the charge amount distribution) is used for forming an image. Besides, in the toner having the above-described feature (1), the charge amount $Q_3$ is 20 μC/g or more. Specifically, the charge amount of the toner attained after stirring for 3 minutes (i.e., the charge amount $Q_3$) is 20 μC/g or more. Therefore, the toner having the feature (1) is excellent in a charge rise characteristic. Incidentally, in order to stably form images with high quality (with a low fogging density, in particular), it is preferable to further satisfy both relationships of "$0\ \mu C/g \leq Q_3 - Q_{30} \leq 5\ \mu C/g$" and "$Q_3 \leq 40\ \mu C/g$". More specifically, the charge amount $Q_3$ is preferably 40 μC/g or less. Besides, a difference ($Q_3 - Q_{30}$) between the charge amount $Q_3$ and the charge amount $Q_{30}$ is preferably 0 μC/g or more and 5 μC/g or less.

Each toner particle contained in the toner of the present embodiment has the following feature (2):

(2) The shell layer contains a first resin and a second resin. The first resin contains at least one repeating unit having an amide group. The second resin contains at least one repeating unit having a quaternary ammonium cation.

If the resin contained in the shell layer contains a repeating unit having a quaternary ammonium cation, there is a tendency that the charge rise characteristic of the toner is improved (i.e., the charge amount of the toner is early saturated). A quaternary ammonium compound has lower colorability than a nitrogen-containing heterocyclic compound (more specifically, nigrosine, imidazole, or the like). Therefore, if a quaternary ammonium compound is contained in a color toner, the quaternary ammonium compound minimally inhibits the coloring of the color toner. Besides, if a resin contained in the shell layer contains a repeating unit having an amide group, there is a tendency that the charge amount distribution of the toner becomes sharp. If the toner particles contained in the toner have the feature (2), the charge characteristics of the toner can be easily controlled to the charge characteristics defined as the feature (1).

Formula (1) represents an example of the repeating unit having a quaternary ammonium cation ($NR_4^+$) (that is, a repeating unit derived from 2-(methacryloyloxy)ethyl trimethylammonium chloride). Formula (2) represents an example of the repeating unit having an amide group (–CO—$NR_2$) (that is, a repeating unit derived from acrylamide). In formulas (1) and (2), n represents a repeating number of the corresponding repeating unit.

(1)

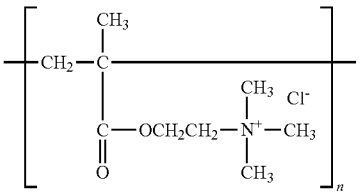

(2)

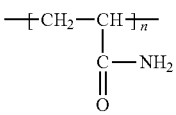

If the toner having the above-described feature (1) is used for image formation, images with high quality (with a low fogging density in particular) can be easily stably formed (see Tables 1 and 2 described later). In order to stably form images with high quality (with a low fogging density in particular) with the toner, the toner preferably contains the toner particles having the above-described feature (2) in a ratio of preferably 80% by number or more, more preferably 90% by number or more, and further preferably 100% by number.

In order to attain both heat-resistant storage stability and low-temperature fixability of the toner, the shell layer covers preferably 50% or more and 99% or less, and more preferably 70% or more and 95% or less of the surface region of the toner core. The shell layer may be a film with no granular feeling, or a film with granular feeling. In a case where resin particles are used as the material for forming the shell layer, if the material (of the resin particles) has been completely dissolved before curing in the form of a film, the resultant shell layer is probably formed as a film with no granular feeling. On the other hand, if the material (of the resin particles) has not been completely dissolved before curing in the form of a film, the resultant shell layer is probably formed as a film in which the resin particles are two-dimensionally arranged (namely, a film with granular feeling). Besides, it is not necessary to integrally form the entire shell layer. The shell layer may be a unified film, or may be a group of a plurality of islands of a film spaced from one another.

In order to form images with high quality (with a low fogging density in particular) with the toner, the shell layer preferably contains first resin particles substantially made of the first resin (i.e., the resin containing at least one repeating unit having an amide group), and second resin particles substantially made of the second resin (i.e., the resin containing at least one repeating unit having a quaternary ammonium cation). In order to stably form images with high quality (with a low fogging density in particular) with the toner, it is preferable that the ratio of the first resin particles in the shell layer is 0.5% by mass or more and 5.0% by mass or less, and that the ratio of the second resin particles in the shell layer is 95.0% by mass or more and 99.5% by mass or less. The ratio (in % by mass) of resin particles in the shell layer can be calculated in accordance with an expression, "100×(Mass of resin constituting resin particles)/(Mass of all resins contained in shell layer)".

A dispersion of toner cores can be obtained by dispersing toner cores in a liquid in which the shell material is dissolved or dispersed. If the shell material is polymerized in the dispersion of the toner cores, it is preferable that the toner cores are anionic and that the shell material is cationic. When the cationic shell material is electrically attracted by the anionic toner cores in the dispersion of the toner cores, the shell layer is easily formed on the surface of each toner core through in-situ polymerization. Besides, the shell layer can be uniformly formed on the surface of the toner core without using a surfactant (or with merely a small amount of a surfactant used).

A zeta potential can be used as an indicator corresponding to the degree of anionicity or cationicity. In order to strongly bonding the toner core and the shell layer to each other, it is preferable that a zeta potential at pH 4 of the toner core is lower than 0 V, and that a zeta potential at pH 4 of the toner particle is higher than 0 V, and it is more preferable that the zeta potential at pH 4 of the toner core is −5 mV or lower, and that the zeta potential at pH 4 of the toner particle is 5 mV or higher. In order that the toner core is strongly anionic, the toner core preferably contains a polyester resin. A zeta potential is measured by a method described below or an alternative method thereof.

<Method for Measuring Zeta Potential>

First, 0.2 g of a sample (of, for example, a toner core or a toner), 80 g of ion-exchanged water, and 20 g of a 1% by mass nonionic surfactant ("K-85" manufactured by Nippon Shokubai Co., Ltd., polyvinyl pyrrolidone) are mixed using a magnet stirrer. Subsequently, the sample is homogeneously dispersed in the resultant liquid to give a dispersion. The thus obtained dispersion is adjust to pH 4 by adding dilute hydrochloric acid thereto, and thus, a dispersion with pH set to 4 is obtained. Thereafter, a zeta potential-particle size analyzer ("Delsa Nano HC" manufactured by Beckman Coulter) is used for measuring a zeta potential of the sample in the dispersion of pH 4 with a temperature of 25° C. by electrophoresis (more specifically, laser Doppler electrophoresis).

Next, the toner core (including a binder resin and an internal additive), the shell layer, and the external additive will be successively described. Any component not necessary depending on the use of the toner may be appropriately omitted. It is noted that an evaluation result (i.e., a value corresponding to the shape, physical property or the like) of a powder (more specifically, toner cores, toner mother particles, an external additive, a toner, or the like) is, unless otherwise specified, a number average of values measured for an appropriate number of particles selected from the powder. Besides, a particle size of a powder is, unless otherwise specified, a circle equivalent diameter of the particle (i.e., a diameter of a circle having the same area as a projected area of the particle). Here, the term "-based" following the name of a compound is used in some cases for comprehensively referring to the compound and derivatives thereof. If the term "-based" following the name of a compound is used for designating a polymer, it means that a repeating unit of the polymer is derived from the compound or a derivative thereof. Besides, the term "(meth) acrylic" is used in some cases for comprehensively referring to acrylic and methacrylic. Furthermore, the term "(meth) acryloyl" is used in some cases for comprehensively referring to acryloyl ($CH_2{=}CH{-}CO{-}$) and methacryloyl ($CH_2{=}C(CH_3){-}CO{-}$).

<Preferable Thermoplastic Resins>

Preferable examples of thermoplastic resins include styrene-based resins, acrylic acid-based resins (more specifically, a polymer of acrylic acid ester and a polymer of methacrylic acid ester), olefin-based resins (more specifically, polyethylene resins and polypropylene resins), vinyl chloride resins, polyvinyl alcohols, vinyl ether resins, N-vinyl resins, polyester resins, polyamide resins, and urethane resins. Also, a copolymer of any of these resins, specifically a copolymer of any of the resins into which an optional repeating unit is introduced (more specifically, styrene-acryl acid-based resins and styrene-butadiene-based resins) may be preferably used.

A thermoplastic resin can be obtained through addition polymerization, copolymerization, or condensation polymerization of at least one thermoplastic monomer. Note that a thermoplastic monomer is a monomer that is to become a thermoplastic resin through homopolymerization (more specifically, an acrylic acid-based monomer or a styrene-based monomer), or a monomer that is to become a thermoplastic resin through condensation polymerization (such as a combination of a polyhydric alcohol and a polycarboxylic acid that is to become a polyester resin through condensation polymerization).

A styrene-acrylic acid-based resin is a copolymer of at least one styrene-based monomer and at least one acrylic acid-based monomer. Styrene-based monomers and acrylic acid-based monomers mentioned below can be suitably used for synthesizing the styrene-acrylic acid-based resin. When an acrylic acid-based monomer having a carboxyl group is used, the carboxyl group can be introduced into the styrene-acrylic acid-based resin. Furthermore, when a monomer having a hydroxyl group (more specifically, p-hydroxystyrene, m-hydroxystyrene, or (meth)acrylic acid hydroxyalkyl ester) is used, the hydroxyl group can be introduced into the styrene-acrylic acid-based resin. When the amount of the acrylic acid-based monomer is adjusted, the acid value of the resultant styrene-acrylic acid-based resin can be controlled. When the amount of the monomer having a hydroxyl group is adjusted, the hydroxyl value of the resultant styrene-acrylic acid-based resin can be controlled.

Preferable examples of the styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of the acrylic acid-based monomers include (meth)acrylic acids, (meth)acrylic acid alkyl esters, and (meth)acrylic acid hydroxyalkyl esters. Preferable examples of the (meth)acrylic acid alkyl esters include methyl (meth)acrylate, ethyl (meth)acrylate, n-propyl (meth)acrylate, isopropyl (meth)acrylate, n-butyl (meth) acrylate, isobutyl (meth)acrylate, and 2-ethylhexyl (meth) acrylate. Preferable examples of the (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

A polyester resin can be prepared through condensation polymerization of at least one polyhydric alcohol and at least one polycarboxylic acid. Examples of the alcohol that can be preferably used for synthesizing the polyester resin include dihydric alcohols (more specifically, diols and bisphenols) and tri- or higher-hydric alcohols, as listed below. Examples of the carboxylic acid that can be preferably used for synthesizing the polyester resin include dibasic carboxylic acids and tri- or higher carboxylic acids, as listed below. When the amounts of the alcohol and the carboxylic acid are respectively changed in the synthesis of the polyester resin, the acid value and the hydroxyl value of the polyester resin can be controlled. The acid value and the hydroxyl value of the polyester resin tend to be lowered by increasing the molecular weight of the polyester resin.

Preferable examples of diols include ethylene glycol, diethylene glycol, triethylene glycol, 1,2-propanediol, 1,3-propanediol, 1,4-butanediol, neopentyl glycol, 2-butene-1, 4-diol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adduct, and bisphenol A propylene oxide adduct.

Preferable examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acid (more specifically, n-butylsuccinic acid, isobutylsuccinic acid, n-octylsuccinic acid, n-dodecylsuccinic acid, and isododecylsuccinic acid), and alkenyl succinic acid (more specifically, n-butenylsuccinic acid, isobutenylsuccinic acid, n-octenylsuccinic acid, n-dodecenylsuccinic acid, and isododecenylsuccinic acid).

Preferable examples of tri- or higher carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

Note that the di-, tri-, or higher carboxylic acids may be deformed into ester-forming derivatives (more specifically, acid halides, acid anhydrides, and lower alkyl esters). The term "lower alkyl" herein is defined as an alkyl group having a carbon number of at least 1 and no greater than 6.

<Preferable Thermosetting Resins>

Examples of thermosetting resins include melamine-based resins, urea-based resins, sulfonamide-based resins, glyoxal-based resins, guanamine-based resins, aniline-based resins, polyimide resins (more specifically, a maleimide polymer and a bismaleimide polymer), and xylene-based resins.

The thermosetting resin can be prepared by cross-linkage (polymerization) of at least one thermosetting monomer. When a crosslinking agent is used, the thermosetting resin can be synthesized by a thermosetting monomer. Note that the thermosetting monomer has a cross-linking property. For example, if monomers of the same species are three-dimensionally linked via "—$CH_2$—" to form a thermosetting resin, the monomers and the "thermosetting monomers" are equivalent.

Preferable examples of the thermosetting monomer include methylol melamine, melamine, methylol urea (more specifically, dimethylol dihydroxyethyleneurea), urea, benzoguanamine, acetoguanamine, and spiroguanamine.

[Toner Cores]

The toner cores contain a binder resin. Furthermore, the toner cores may optionally contain an internal additive (for example, a colorant, a releasing agent, a charge control agent, or a magnetic powder).

(Binder Resin)

The binder resin generally constitutes a large proportion (for example, 85% by mass or more) of components of each toner core. Properties of the binder resin are therefore expected to have great influence on the overall property of the toner core. For example, if the binder resin has an ester group, a hydroxyl group, an ether group, an acid group, or a methyl group, the toner core is highly likely to be anionic. If the binder resin has an amino group or an amide group, the toner core is highly likely to be cationic. In order to improve the reactivity between the toner core and the shell layer, the hydroxyl value (measured in accordance with JIS (Japanese Industrial Standards) K0070-1992) and the acid value (measured in accordance with JIS (Japanese Industrial Standards) K0070-1992) of the binder resin are preferably 10 mgKOH/g or more, and more preferably 20 mgKOH/g or more.

The binder resin is preferably a resin having at least one group selected from the group consisting of an ester group, a hydroxyl group, an ether group, an acid group, and a methyl group, and more preferably a resin having a hydroxyl group and/or a carboxyl group. A binder resin having such a functional group is readily reacted with the shell material to be chemically bonded thereto. This chemical bond enhances the bond between the toner core and the shell layer. Alternatively, the binder resin is preferably a resin having, in a molecule thereof, a functional group containing active hydrogen.

In order to improve the fixability of the toner in high speed fixing, the binder resin preferably has a glass transition point (Tg) of 20° C. or higher and 55° C. or lower. In order to improve the fixability of the toner in the high speed fixing, the binder resin preferably has a softening point (Tm) of 100° C. or lower. The glass transition point (Tg) and the softening point (Tm) are measured by methods employed in the examples described later or alternative methods thereof. The glass transition point (Tg) and the softening point (Tm) of the binder resin can be controlled by changing the types or the amounts of components (monomers) of the resin. When a plurality of resins are used in combination, the glass transition point (Tg) and the softening point (Tm) of the binder resin can be controlled.

Thermoplastic resins (more specifically, those mentioned in "Preferable Thermoplastic Resins" above) are preferably used as the binder resin of the toner core. In order to improve dispersibility of a colorant in the toner core, chargeability of the toner, and fixability of the toner to a recording medium, a styrene-acrylic acid-based resin or a polyester resin is particularly preferably used as the binder resin.

If a styrene-acrylic acid-based resin is used as the binder resin of the toner core, in order to improve strength of the toner core and fixability of the toner, the styrene-acrylic acid-based resin preferably has a number average molecular weight (Mn) of at least 2,000 and no greater than 3,000. The styrene-acrylic acid-based resin preferably has a molecular weight distribution (a ratio Mw/Mn of a mass average molecular weight (Mw) to the number average molecular weight (Mn)) of at least 10 and no greater than 20. The gel permeation chromatography can be employed for measuring the molecular weights Mn and Mw of the styrene-acrylic acid-based resin.

If a polyester resin is used as the binder resin of the toner core, in order to improve the strength of the toner core and the fixability of the toner, the polyester resin preferably has a number average molecular weight (Mn) of at least 1,000 and no greater than 2,000. The polyester resin preferably has a molecular weight distribution (a ratio Mw/Mn of the mass average molecular weight (Mw) to the number average molecular weight (Mn)) of at least 9 and no greater than 21. The gel permeation chromatography can be employed for measuring the molecular weights Mn and Mw of the polyester resin.

(Colorant)

The toner cores may optionally contain a colorant. The colorant can be a known pigment or dye that matches the color of the toner. The amount of the colorant is preferably at least 1 part by mass and no greater than 20 parts by mass, and more preferably at least 3 parts by mass and no greater than 10 parts by mass based on 100 parts by mass of the binder resin in order to form a high-quality image with the toner.

The toner cores may contain a black colorant. Carbon black can be used as the black colorant. The black colorant may be a colorant that is adjusted to a black color using a yellow colorant, a magenta colorant, and a cyan colorant.

The toner core may contain a non-black colorant such as a yellow colorant, a magenta colorant, or a cyan colorant.

The yellow colorant can be at least one compound selected from the group consisting of condensed azo compounds, isoindolinone compounds, anthraquinone compounds, azo metal complexes, methine compounds, and arylamide compounds. Specific examples of the yellow colorant that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant can be at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the magenta colorant that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant can be at least one compound selected from the group consisting of copper phthalocyanine compounds, anthraquinone compounds, and basic dye lake compounds. Specific examples of the cyan colorant that can be preferably used include C.I. Pigment Blue (1, 7, 15, 15:1, 15:2, 15:3, 15:4, 60, 62, or 66), Phthalocyanine Blue. C.I. Vat Blue, and C.I. Acid Blue.

(Releasing Agent)

The toner cores may optionally contain a releasing agent. The releasing agent is for example used in order to improve the fixability or the offset resistance of the toner. In order to improve anionic strength of the toner cores, the toner cores are preferably prepared using an anionic wax. In order to improve the fixability or the offset resistance of the toner, the amount of the releasing agent is preferably at least 1 part by mass and no greater than 30 parts by mass, and more preferably at least 5 parts by mass and no greater than 20 parts by mass based on 100 parts by mass of the binder resin.

Examples of the releasing agent that can be preferably used include aliphatic hydrocarbon waxes such as low molecular weight polyethylene, low molecular weight polypropylene, a polyolefin copolymer, a polyolefin wax, microcrystalline wax, paraffin wax, and Fischer-Tropsch wax; oxides of aliphatic hydrocarbon waxes such as polyethylene oxide wax and a block copolymer of polyethylene oxide wax: plant waxes such as candelilla wax, camauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized camauba wax. One of releasing agents may be singly used or a combination of a plurality of releasing agents may be used.

A compatibilizer may optionally be added to the toner cores in order to improve compatibility between the binder resin and the releasing agent.

(Charge Control Agent)

The toner cores may optionally contain a charge control agent. The charge control agent is used, for example, in order to improve the charge stability or the charge rise characteristic of the toner. The charge rise characteristic of the toner is an indicator as to whether the toner can be charged to a specific charge level in a short period of time.

The anionic strength of the toner cores can be increased by causing the toner cores to contain a negatively chargeable charge control agent. The cationic strength of the toner cores can be increased by causing the toner cores to contain a positively chargeable charge control agent. However, if the toner is sufficiently chargeable, there is no need to use a charge control agent.

(Magnetic Powder)

The toner cores may optionally contain a magnetic powder. Examples of the material of the magnetic powder that can be preferably used include ferromagnetic metals (more specifically, iron, cobalt, and nickel, or an alloy of at least one of such ferromagnetic metals), ferromagnetic metal oxides (more specifically, ferrite, magnetite, and chromium dioxide), and materials subjected to ferromagnetization (more specifically, carbon materials provided with ferromagnetism by a thermal treatment). One of the magnetic powders may be singly used or a combination of a plurality of the magnetic powders may be used.

The magnetic powder is preferably subjected to a surface treatment in order to inhibit elution of metal ions (for example, iron ions) from the magnetic powder. If a shell layer is formed on the surface of each toner core under acidic conditions, elution of metal ions to the surface of the toner core causes the toner core to adhere to other toner cores more readily. The adhesion of the toner cores to one another can be inhibited by inhibiting the elution of metal ions from the magnetic powder.

[Shell Layer]

In each of the toner particles having the above-described feature (2), the shell layer contains the first resin (i.e., the resin containing at least one repeating unit having an amide group), and the second resin (i.e., the resin containing at least one repeating unit having a quaternary ammonium cation). The shell layer may further contain a thermosetting resin (more specifically, any of those mentioned in "Preferable Thermosetting Resins" above) in addition to the first resin and the second resin. In order to improve the charge stability and the heat-resistant storage stability of the toner, the shell layer preferably contains at least one thermosetting resin selected from the group consisting of melamine-based resins, urea-based resins, and glyoxal-based resins in a ratio of 0.1% by mass or more and 10% by mass or less based on the entire resin.

(First Resin)

In the feature (2), the first resin is preferably a thermoplastic resin (more specifically, any of those mentioned in "Preferable Thermoplastic Resins" above) containing a repeating unit derived from an amide compound, and is particularly preferably a copolymer of at least one styrene-based monomer (such as styrene), at least one acrylic acid-based monomer (such as acrylic acid ester), and at least one amide compound monomer (such as acrylamide). In order to improve the charge stability of the toner under a high-temperature and high-humidity environment, the first resin contained in the shell layer is preferably a resin containing merely at least one repeating unit not having a hydroxyl group.

(Second Resin)

In the feature (2), the second resin is preferably a thermoplastic resin (more specifically, any of those mentioned in "Preferable Thermoplastic Resins" above) containing a repeating unit derived from a quaternary ammonium compound, and is particularly preferably a copolymer of at least one quaternary ammonium compound monomer (such as a quaternary ammonium salt), and at least one acrylic acid-based monomer (such as acrylic acid ester). In order to improve the charge stability of the toner under a high-temperature and high-humidity environment, the second resin contained in the shell layer is preferably a resin containing merely at least one repeating unit not having a hydroxyl group.

If the shell layer contains the first resin particles substantially made of the first resin, and the second resin particles substantially made of the second resin, in order to stably form images with high quality (with a low fogging density in particular), it is particularly preferable that the first resin is a copolymer of a styrene-based monomer, an acrylic acid alkyl ester monomer, and an acrylamide, and that the second resin is a copolymer of a (meth)acryloyl group-containing quaternary ammonium compound monomer, a methacrylic acid alkyl ester monomer containing, in an ester portion thereof, an alkyl group having 1 or 2 carbon atoms, and an acrylic acid alkyl ester monomer containing, in an ester portion thereof, an alkyl group having at least 3 and no greater than 6 carbon atoms. A preferable example of the styrene-based monomer includes styrene. A preferable example of the acrylic acid alkyl ester monomer includes butyl acrylate. Preferable examples of the (meth)acryloyl group-containing quaternary ammonium compound monomer include (meth)acrylamide alkyl trimethyl ammonium salts (more specifically, (3-acrylamide propyl)trimethyl ammonium chloride), and (meth)acryloyloxy alkyl trimethyl ammonium salts (more specifically, 2-(methacryloyloxy) ethyl trimethyl ammonium chloride). A preferable example of the methacrylic acid alkyl ester monomer containing, in an ester portion thereof, an alkyl group having 1 or 2 carbon atoms includes methyl methacrylate. A preferable example of the acrylic acid alkyl ester monomer containing, in an ester portion thereof, an alkyl group having at least 3 and no greater than 6 carbon atoms includes butyl acrylate.

[External Additive]

An external additive (more specifically, a powder containing a plurality of external additive particles) may optionally be caused to adhere to the surfaces of the toner mother particles. For example, when the external additive (in the form of a powder) is stirred together with the toner mother particles (in the form of a powder), the external additive is caused to adhere (physically bond) to the surfaces of the toner mother particles by physical force. The external additive may be used, for example, in order to improve fluidity or handling property of the toner. The amount of the external additive is preferably 0.5 parts by mass or more and 10 parts by mass or less based on 100 parts by mass of the toner mother particles in order to improve the fluidity or handling property of the toner. In order to improve the fluidity or handling property of the toner, the external additive preferably has a particle size of 0.01 μm or more and 1.0 μm or less.

Silica particles, or particles of a metal oxide (more specifically, alumina, titanium oxide, magnesium oxide, zinc oxide, strontium titanate, or barium titanate) are preferably used as the external additive particles. One of such external additives may be singly used or a plurality of external additives may be used.

[Method for Producing Toner]

Now, an example of a method for producing the toner of the present embodiment having the aforementioned features will be described. First, toner cores are prepared. Subsequently, the toner cores and a shell material are added to a liquid. In order to form a homogeneous shell layer, the shell material is preferably dissolved or dispersed in the liquid by, for example, stirring the liquid containing the shell material. Then, the shell material is reacted in the liquid to form a shell layer (a cured film) on the surface of each toner core. In order to inhibit the components of the toner core (particularly, a binder resin and a releasing agent) from dissolving or eluting in forming the shell layer, the shell layer is formed preferably in an aqueous medium. The aqueous medium refers to a medium containing water as a main component (more specifically, pure water, or a mixed liquid of water and a polar medium). The aqueous medium may be allowed to function as a solvent. The aqueous medium may contain a solute dissolved therein. The aqueous medium may be allowed to function as a dispersion medium. The aqueous medium may contain a dispersoid dispersed therein. The polar medium possibly contained in the aqueous medium can be, for example, an alcohol (more specifically, methanol or ethanol).

The method for producing the toner of the present embodiment will now be further described with reference to more specific examples.

(Preparation of Toner Cores)

In order to easily obtain preferable toner cores, the toner cores are prepared preferably by an aggregation method or a pulverization method, and more preferably by the pulverization method.

An example of the pulverization method will now be described. First, a binder resin, an internal additive (for example, at least one of a colorant, a releasing agent, a charge control agent, and a magnetic powder) are mixed. The resultant mixture is then melted and kneaded. Next, the resultant melt-kneaded product is pulverized and then classified. In this manner, toner cores having a desired particle size are prepared.

An example of the aggregation method will now be described. First, a binder resin, a releasing agent, and a colorant all in the form of fine particles are caused to aggregate in an aqueous medium until a desired particle size can be attained. Thus, aggregated particles containing components of the binder resin, the releasing agent, and the colorant are formed. Subsequently, the resultant aggregated particles are heated to cause coalescence of the components contained in the aggregated particles. As a result, a dispersion of toner cores is obtained. Thereafter, unnecessary substances (a dispersant and the like) are removed from the dispersion of the toner cores to produce the toner cores.

(Formation of Shell Layer)

For example, ion-exchanged water is prepared as the aqueous medium to which the toner cores and the shell material are added. Subsequently, the pH of the aqueous medium is controlled to a prescribed pH (of, for example, 3 or more and 5 or less) using, for example, hydrochloric acid. Subsequently, to the aqueous medium having a controlled pH (namely, an acidic aqueous medium for example), the toner cores, a suspension of the first resin (i.e., a liquid containing the first resin particles), and a suspension of the second resin (i.e., a liquid containing the second resin particles) are added. Besides, materials for synthesizing a thermosetting resin may be added to the aqueous medium if necessary.

The shell material and the like may be added to the aqueous medium at room temperature, or to the aqueous medium having a temperature controlled to a prescribed temperature. An appropriate additive amount of the shell material can be calculated based on the specific surface area of the toner cores. A polymerization accelerator may be optionally added to the aqueous medium in addition to the shell material.

Preferably the toner cores are highly dispersed in the liquid containing the shell material in order to uniformly attach the shell material to the surfaces of the toner cores. In order to highly disperse the toner cores in the liquid, the liquid may contain a dispersant or be stirred using a stirring device having strong power (for example, "Hivis Disper Mix" manufactured by PRIMIX Corporation).

Subsequently, the liquid containing the shell material and the like is increased, under stirring, in temperature up to a prescribed retention temperature (for example, a temperature of at least 50° C. and no higher than 85° C.) at a predetermined rate (for example, a rate of at least 0.1° C./min and no greater than 3° C./min). The temperature of the liquid is then maintained at the retention temperature for a prescribed time period (for example, at least 30 minutes and no greater than 4 hours) under stirring. While the liquid is being maintained at a high temperature (or increased in temperature), a reaction (curing of the shell layer) is probably proceeded between the toner cores and the shell material. When the shell material is chemically bonded to the toner core, the shell layer covering the surface of the toner core is formed. More specifically, the shell layer substantially containing the resins (for example, the first resin and the second resin) is formed into a film on the surface of the toner core.

In this manner, the resin particles are caused to adhere to the surfaces of the toner cores in the liquid, and the resultant liquid is heated to dissolve (or deform) the resin particles to be formed into a film. The resin particles, however, may be formed into a film through heating in a drying process or by physical impact applied in an external addition process.

The roundness of the toner mother particles can be controlled by changing at least one of the retention temperature, and a retention time for maintaining the retention temperature. In order to inhibit the toner core components from eluting, or to inhibit the toner core from deforming, the retention time (i.e., the temperature of the liquid at which the shell layer is formed) is preferably below the glass transition point (Tg) of the toner cores. However, the toner cores may be forcedly deformed by setting the retention temperature to be at least the glass transition point (Tg) of the toner cores. High retention temperature can promote deformation of the toner cores, and as a result, the shape of each toner mother particle tends to approximate to a true sphere. It is desirable to control the retention temperature so that the toner mother particles have a desired shape. When the shell material is caused to react at a high temperature, the shell layer tends to be hard.

After forming the shell layer as described above, the dispersion of the toner mother particles is neutralized using, for example, sodium hydroxide. The dispersion of the toner mother particles is then cooled to, for example, normal temperature (of about 25° C.). Subsequently, the dispersion of the toner mother particles is filtrated using, for example, a Buchner funnel. In this manner, the toner mother particles are separated (solid-liquid separated) from the liquid to collect a wet cake of the toner mother particles. The collected wet cake of the toner mother particles is then washed. Subsequently, the washed toner mother particles are dried. Thereafter, if necessary, the toner mother particles and an external additive may be mixed using a mixer (for example, an FM mixer manufactured by Nippon Coke & Engineering Co., Ltd.) to cause the external additive to adhere to the surfaces of the toner mother particles. If a spray dryer is used in the drying process, the drying process and the external addition process can be carried out simultaneously by spraying a dispersion of an external additive (such as silica particles) toward the toner mother particles. In this manner, a toner including a large number of toner particles is produced.

The contents and the order of the processes in the method for producing the toner described above may be altered as appropriate in accordance with requirements of the toner, such as in terms of composition and properties. For example, the pH of the liquid (for example, the aqueous medium) may be controlled before or after the shell material and the like (for example, the shell material, and the toner cores) are added to the liquid. The shell material and the like may be added altogether at one time or separately. Besides, before adding the shell material and the like to the liquid, the liquid may be heated to the retention temperature. Furthermore, if a material (for example, the shell material) is caused to react in the liquid, the material may be caused to react in the liquid for a predetermined time period after the material is added to the liquid. Alternatively, the material may be caused to react in the liquid while being added to the liquid over long time. The shell material may be added to the liquid at one time or in plural times. The shell layer may be formed by any method. For example, the shell layer may be formed by an in-situ polymerization method, a film formation method by curing in a liquid, or a coacervation method. The toner may be sifted after the external addition process. Non-essential processes may alternatively be omitted. For example, if the reaction of the shell material satisfactorily proceeds without controlling the pH of the liquid, the process of controlling the pH may be omitted. If there is no need to use an external additive, the external addition process may be omitted. If an external additive is not caused to adhere to the surfaces of the toner mother particles (namely, the external addition process is omitted), the toner mother particles and the toner particles are equivalent. A material for forming the toner cores (hereinafter referred to as the toner core material) and the shell material are not limited to the above-described compounds (such as the monomers for synthesizing the resins). For example, derivatives of the above-described compounds may be used as the toner core material or the shell material if necessary, or a prepolymer may be used instead of the monomer. Besides, in order to obtain any of the above-described compounds, a salt, an ester, a hydrate, or an anhydride of the compound may be used as a raw material. The respective materials may be used in a solid state or a liquid state. For example, a powdery material in a solid state may be used, a resin into which a material is kneaded (such as a master batch) may be used, a solution of a material (the material in a liquid state dissolved in a solvent) may be used, or a dispersion of a material (a liquid in which the material in a solid state is dispersed) may be used. In order to efficiently produce the toner, preferably a large number of toner particles are produced at the same time.

EXAMPLES

Examples of the present disclosure will now be described. Table 1 shows details of toners A-1 to A-4, B-1, B-2, C-1, and C-2 (positively chargeable toners) according to examples or comparative examples.

TABLE 1

| | Shell Layer Formation | | Charge Characteristics | | |
|---|---|---|---|---|---|
| Toner | First Material [g] | Second Material [g] | $Q_3$ [μC/g] | $Q_{30} - Q_3$ [μC/g] | Coefficient of Variation (Y/X) |
| A-1 | 2.0 | 30.0 | 28 | −4 | 2.1 |
| A-2 | 2.0 | 15.0 | 23 | −3 | 2.4 |
| A-3 | 1.0 | 30.0 | 27 | −2 | 2.8 |
| A-4 | 1.0 | 15.0 | 22 | −2 | 3.0 |
| B-1 | 2.0 | — | 5 | −1 | 2.7 |

TABLE 1-continued

| Toner | Shell Layer Formation: First Material [g] | Shell Layer Formation: Second Material [g] | Charge Characteristics: $Q_3$ [μC/g] | Charge Characteristics: $Q_{30} - Q_3$ [μC/g] | Charge Characteristics: Coefficient of Variation (Y/X) |
|---|---|---|---|---|---|
| B-2 | 1.0 | — | 3 | −1 | 2.3 |
| C-1 | — | 30.0 | 23 | 0 | 3.9 |
| C-2 | — | 15.0 | 19 | 2 | 4.2 |

Production methods of the respective toners A-1 to C-2 (positively chargeable toners), evaluation methods, and evaluation results are successively described below. In an evaluation in which errors may occur, an evaluation value was calculated by calculating the arithmetic mean of an appropriate number of measured values in order to ensure that any errors were sufficiently small. A measured value of the number average particle size is, unless otherwise specified, a value measured with a particle imaged by a transmission electron microscope (TEM). Besides, a measured value of a volume median diameter ($D_{50}$) is, unless otherwise specified, a value obtained through measurement with "Coulter Counter Multisizer 3" manufactured by Beckman Coulter, Inc. A measured value of a zeta potential is, unless otherwise specified, a value measured with a zeta potential-particle size analyzer ("Delsa Nano HC" manufactured by Beckman Coulter) (more specifically, a value measured by the above-described method). Methods for measuring a glass transition point (Tg) and a softening point (Tm) are as follows unless otherwise specified.

<Method for Measuring Glass Transition Point (Tg)>

A heat absorption curve (ordinate: heat flow (DSC signal), abscissa: temperature) of a sample (for example, a resin) was plotted using a differential scanning calorimeter ("DSC-6220" manufactured by Seiko Instruments Inc.). Subsequently, the glass transition point (Tg) of the sample was read from the plotted heat absorption curve. The glass transition point (Tg) of the sample is a temperature on the plotted heat absorption curve corresponding to a point of variation of the specific heat (an intersection point of an extrapolated baseline and an extrapolated fall line).

<Method for Measuring Softening Point (Tm)>

An S-shaped curve (abscissa: temperature, ordinate: stroke) of a sample (for example, a resin) was plotted by placing the sample in a capillary rheometer ("CFT-500D" manufactured by Shimadzu Corporation) and causing melt-flow of 1 $cm^3$ of the sample under conditions of a die pore diameter of 1 mm, a plunger load of 20 $kg/cm^2$, and a heating rate of 6° C./min. Subsequently, the softening point (Tm) of the sample was read from the plotted S-shaped curve. The softening point (Tm) of the sample is a temperature on the plotted S-shaped curve corresponding to a stroke value of $(S_1+S_2)/2$, where $S_1$ represents a maximum stroke value and $S_2$ represents a baseline stroke value at low temperatures.

[Method for Producing Toner A-1]

(Preparation of Toner Cores)

An FM mixer (manufactured by Nippon Coke & Engineering Co., Ltd.) was used to mix 750 g of a low-viscosity polyester resin (Tg=38° C., Tm=65° C.), 100 g of an intermediate-viscosity polyester resin (Tg=53° C. Tm=84° C.), 150 g of a high-viscosity polyester resin (Tg=71° C. Tm=120° C.), 55 g of a camauba wax ("Camauba Wax No. 1" manufactured by S. KATO & CO.), and 40 g of a colorant (phthalocyanine blue, "KET BLUE 111" produced by DIC Corporation) at a rotational speed of 2,400 rpm.

Subsequently, the resultant mixture was melt-knead using a twin-screw extruder ("PCM-30" manufactured by Ikegai Corp.) under conditions of a material input rate of 5 kg/hour, a shaft rotational speed of 160 rpm, and a temperature setting range (cylinder temperature) of 100° C. or higher and 130° C. or lower. The resultant melt-knead product was cooled, and the cooled melt-knead product was coarsely pulverized using a pulverizer ("Rotoplex (registered Japanese trademark)" manufactured by Hosokawa Micron Corporation). Next, the coarsely pulverized product was finely pulverized using a jet mill ("Supersonic Jet Mill I" manufactured by Nippon Pneumatic Mfg. Co., Ltd.). The finely pulverized product was then classified using a classifier ("Elbow Jet EJ-LABO" manufactured by Nittetsu Mining Co., Ltd.). In this manner, toner cores having a volume median diameter ($D_{50}$) of 6 μm were prepared.

(Preparation of First Shell Material)

A 1-L three-necked flask equipped with a thermometer and a stirring impeller was set in a water bath at 30° C. Then, 875 mL of ion-exchanged water and 75 mL of a cationic surfactant ("QUARTAMIN (registered Japanese trademark) 24P" manufactured by Kao Corporation, component: lauryl trimethyl ammonium chloride) were added into the flask. Subsequently, the internal temperature of the flask was increased to 80° C. using the water bath, and thereafter was retained at that temperature (80° C.). Next, two liquids (a first liquid and a second liquid) were added dropwise over 5 hours each to the flask contents. The first liquid was a mixed liquid of 18 g of styrene, 2 g of butyl acrylate, and 2 g of acrylamide. The second liquid was a solution of 0.5 g of potassium persulfate dissolved in 30 mL of ion-exchanged water. The internal temperature of the flask was then maintained at 80° C. for additional 2 hours for polymerization of the flask contents. As a result, a suspension (hereinafter referred to as the amide group-containing suspension) of resin particulates (of an amide-group containing resin) having a solid concentration of 5% by mass was prepared. The resin particulates contained in the prepared amide-group containing suspension had a number average particle size of 26 nm and a zeta potential at pH 4 of 58 mV. The zeta potential was measured using an ultrasonic particle size distribution-zeta potential measurement apparatus ("DT-1200" manufactured by Dispersion Technology, Inc.).

(Preparation of Second Shell Material)

A 1-L three-necked flask equipped with a thermometer, a condenser tube, a nitrogen inlet tube, and a stirring impeller was charged with 90 g of isobutanol, 100 g of methyl methacrylate, 35 g of butyl acrylate, 30 g of 2-(methacryloyloxy)ethyl trimethyl ammonium chloride (manufactured by Alfa Aesar), and 6 g of 2,2'-azobis(2-methyl-N-(2-hydroxyethyl)propionamide) ("VA-086" manufactured by Wako Pure Chemical Industries, Ltd.). Subsequently, the flask contents were reacted at 80° C. under a nitrogen atmosphere for 3 hours. Thereafter, 3 g of 2,2'-azobis(2-methyl-N-(2-hydroxyethyl)propionamide) ("VA-086" manufactured by Wako Pure Chemical Industries, Ltd.) was added to the flask, and the resultant flask contents were further reacted at 80° C. under a nitrogen atmosphere for another 3 hours to give a liquid containing a polymer. Subsequently, the thus obtained liquid containing the polymer was dried at 150° C. under a reduced pressure atmosphere. Thereafter, the dried polymer was crushed to give a positively chargeable resin.

Subsequently, a vessel of a mixer ("HIVIS MIX 2P-1" manufactured by Primix Corporation) was charged with 200 g of the positively chargeable resin obtained as described above, and 184 mL of ethyl acetate ("Ethyl Acetate Special Grade" manufactured by Wako Pure Chemical Industries, Inc.). Then, the mixer was used for stirring the contents of the vessel at a rotational speed of 20 rpm for 1 hour to give a highly viscous solution. To the thus obtained highly viscous solution, an aqueous solution of ethyl acetate and the like (more specifically, an aqueous solution of 18 mL of IN hydrochloric acid, 20 g of a cationic surfactant ("QUARTAMIN 24P" manufactured by Kao Corporation, component: lauryl trimethyl ammonium chloride), and 16 g of ethyl acetate ("Ethyl Acetate Special Grade" manufactured by Wako Pure Chemical Industries, Ltd.) dissolved in 562 mL of ion-exchanged water) was added. As a result, a suspension (hereinafter referred to as the positively chargeable suspension) of positively chargeable resin particulates (of a quaternary ammonium cation-containing resin) having a solid content of 30% by mass was prepared. The resin particulates contained in the prepared positively chargeable suspension had a number average particle size of 35 nm and a zeta potential at pH 4 of 46 mV. The zeta potential was measured using the ultrasonic particle size distribution-zeta potential measurement apparatus ("DT-1200" manufactured by Dispersion Technology, Inc.).

(Shell Layer Formation Process)

A 1-L three-necked flask equipped with a thermometer and a stirring impeller was set in a water bath, and 100 mL of ion-exchanged water was added into the flask. Subsequently, the internal temperature of the flask was maintained at 30° C. using the water bath. Subsequently, dilute hydrochloric acid was added into the flask to adjust the pH of the flask content to 3. Then, 2 g of the first shell material (that is, the amide group-containing suspension prepared as described above) and 30 g of the second shell material (that is, the positively chargeable suspension prepared as described above) were added into the flask.

Subsequently, 300 g of the toner cores (that is, the toner cores prepared as described above) was added into the flask, and the flask contents were stirred at a rotational speed of 200 rpm for 1 hour. Thereafter, 300 mL of ion-exchanged water was added into the flask. Then, the internal temperature of the flask was increased at a rate of 1° C./min up to 70° C. under stirring at a rotational speed of 100 rpm. The flask contents were stirred at 70° C. and a rotational speed of 100 rpm for 2 hours.

Thereafter, sodium hydroxide was added into the flask to adjust the pH of the flask contents to 7. Then, the flask contents were cooled to normal temperature (of about 25° C.) to give a dispersion containing toner mother particles.

(Washing Process)

A wet cake of the toner mother particles was collected from the dispersion of the toner mother particles obtained as described above by filtration (solid-liquid separation) using a Buchner funnel. Thereafter, the collected wet cake of the toner mother particles was re-dispersed in ion-exchanged water. Furthermore, dispersion and filtration were repeated five times for washing the toner mother particles.

(Drying Process)

Subsequently, the resultant toner mother particles were dispersed in an aqueous solution of ethanol at a concentration of 50% by mass. As a result, a slurry of the toner mother particles was prepared. Next, the prepared slurry was then fed into a continuous type surface modifier ("Coatmizer (registered Japanese trademark)" manufactured by Freund Corporation) to dry the toner mother particles in the slurry under conditions of a hot air temperature of 45° C. and a blower air flow rate of 2 $m^3$ min. As a result, a powder of toner mother particles was obtained.

(External Addition Process)

Subsequently, the resultant toner mother particles were subjected to the external addition process. Specifically, a 10-L FM mixer (manufactured by Nippon Coke & Engineering Co., Ltd.) was used to mix 100 parts by mass of the toner mother particles, 1.5 parts by mass of hydrophobic silica particulates (i.e., dry silica particles having been surface treated with a trimethylsilyl group and an amino group, number average primary particle size: about 12 nm: "AEROSIL (registered Japanese trademark) RA-200H" manufactured by Nippon Aerosil Co., Ltd.), 1.5 parts by mass of conductive titanium oxide particulates ("EC-100" manufactured by Titan Kogyo Ltd., substrate: $TiO_2$ particle, coat layer: Sb-doped $SnO_2$ film, number average primary particle size: about 0.35 μm) for 5 minutes to cause the external additives (the silica particles and the titanium oxide particles) to adhere to the surfaces of the toner mother particles. Thereafter, the resultant powder was sifted using a 200 mesh (opening 75 μm) sieve to yield the toner A-1 containing a large number of toner particles.

[Methods for Producing Toners A-2 to C-2]

The toners A-2 to C-2 were respectively produced in the same manner as the toner A-1 except that the additive amounts of the first shell material (i.e., the amide group-containing suspension) and the second shell material (i.e., the positively chargeable suspension) were changed in the shell layer formation process as shown in Table 1. In the production of the toners B-1 and B-2, the second shell material (i.e., the positively chargeable suspension) was not used. In the production of the toners C-1 and C-2, the first shell material (i.e., the amide group-containing suspension) was not used.

[Evaluation Methods]

Each sample (of the toners A-1 to C-2) was evaluated as follows.

(Charge Amount of Toner)

A ball mill was used for mixing 100 parts by mass of a standard carrier (standard carrier P-01 provided by The Imaging Society of Japan) and 10 parts by mass of the sample (the toner) for 30 minutes to prepare a developer for evaluation use. The thus obtained evaluation developer was allowed to stand still under an environment of a temperature of 23° C. and a humidity of 60% RH for 24 hours. Thereafter, the evaluation developer was stirred under an environment of a temperature of 23° C. and a humidity of 60% RH using a shaker mixer ("Tubula (registered Japanese trademark) mixer T2F" manufactured by Willy A. Bachofen (WAB)), and a charge amount $Q_3$ of the sample (the toner) contained in the evaluation developer after stirring for 3 minutes (hereinafter referred to as the 3-minute stirred developer), and a charge amount $Q_{30}$ of the sample (the toner) contained in the evaluation developer after stirring for 30 minutes (hereinafter referred to as the 30-minute stirred developer) were measured. A Q/m meter ("MODEL 210HS" manufactured by TREK) was used for measuring the charge amounts of the toner. Specifically, the evaluation developer (the 3-minute stirred developer or the 30-minute stirred developer) was loaded into a measurement cell of the Q/m meter, and merely the toner out of the loaded evaluation developer was sucked through a sieve (a mesh) for 10 seconds. Thereafter, the charge amount (in μC/g) of the sample (the toner) was calculated in accordance with an expression "Total quantity of electricity of sucked toner (μC)/Amount of sucked toner (g)".

(Charge Amount Distribution of Toner)

A color printer ("FS-C5400DN" manufactured by KYOCERA Document Solutions Inc.) was used as an evaluation apparatus. A development roller included in a developing unit of the evaluation apparatus included a magnet roll and a development sleeve. A shaft of the magnet roll and the development sleeve were connected to each other via a flange so that the development sleeve could rotate around the irrotational magnet roll. A cylindrical electrode was allowed to oppose, via a gap of 5 mm, the surface of the development sleeve of the evaluation apparatus. The electrode was electrically connected to one end of a direct current source, with the other end of the direct current source electrically grounded.

A ball mill was used for mixing 100 parts by mass of a standard carrier (standard carrier P-01 provided by The Imaging Society of Japan) and 10 parts by mass of the sample (the toner) for 30 minutes to prepare a developer for evaluation use. The thus obtained evaluation developer was stirred under an environment of a temperature of 23° C. and a humidity of 60% RH for 30 minutes. Thus, the charge amount of the sample (the toner) contained in the evaluation developer was saturated. Thereafter, 3 g of the evaluation developer was filled in the developing unit of the evaluation apparatus under an environment of a temperature of 23° C. and a humidity of 60% RH, and the development sleeve was rotated at a rotational speed of 500 rpm to cause the development sleeve to bear, on a surface thereof, the sample (the toner) and the standard carrier. With continuously rotating the development sleeve at a rotational speed of 500 rpm, the direct current source was used for electrolytically separating the sample (the toner) alone from the surface of the development sleeve under a condition of an electrolysis intensity of 1 kV/cm, and thus, the sample (the toner) was recovered. The recovered sample (toner) was placed in a particle size electrostatic charge distribute analyzer ("E-spart Analyzer (registered Japanese trademark) EST-II" manufactured by Hosokawa Micron Corporation) to measure the charge amount distribution (ordinate: count, and abscissa: charge amount) of the sample (the toner). Besides, a ratio Y/X (i.e., a coefficient of variation) of an arithmetic mean X and a standard deviation Y of the thus measured charge amount distribution was obtained.

(Fogging Density)

A color printer ("FS-C5400DN" manufactured by KYOCERA Document Solutions Inc.) was used as an evaluation apparatus. A two-component developer was prepared by mixing 90 parts by mass of a developer carrier (a carrier for FS-C5400DN) and 10 parts by mass of the sample (the toner) for 30 minutes using a ball mill. The thus prepared two-component developer was loaded into a developing device of the evaluation apparatus, and the sample (as a supplement toner) was loaded into a toner container of the evaluation apparatus.

The evaluation apparatus was turned on, and after attaining a stable state of the evaluation apparatus, the evaluation apparatus was operated for forming, on evaluation paper, a sample image including a solid portion and a blank portion under an environment of normal temperature and normal humidity (specifically, a temperature of 23° C. and a humidity of 60% RH). Subsequently, a fogging density (FD) was measured in the sample image thus formed.

Next, the evaluation apparatus was operated for continuously printing 10,000 sheets (A4 size printing paper) with a coverage of 5% under an environment of normal temperature and normal humidity (specifically, a temperature of 23° C. and a humidity of 60% RH). Thereafter, a sample image including a solid portion and a blank portion was formed on evaluation paper. Subsequently, a fogging density (FD) was measured in the sample image thus formed.

In the measurement of the fogging densities at the initial stage and after the printing of 10,000 sheets, a value obtained by subtracting an image density (ID) of base paper (unprinted evaluation paper) from an image density (ID) in the blank portion of the sample image corresponds to the fogging density (FD). For measuring the image density (ID), a reflection densitometer ("SpectroEye (registered Japanese trademark)" manufactured by X-Rite, Inc.) was used.

If the measured fogging density (FD) was lower than 0.010, the sample (the toner) was evaluated as good, and if the fogging density was 0.010 or more, the sample was evaluated as poor.

[Evaluation Results]

Table 2 shows evaluation results of the toners A-1 to C-2.

TABLE 2

| | | Fogging Density (FD) | |
|---|---|---|---|
| | Toner | Initial | After Printing Durability Test (10,000 sheets) |
| Example 1 | A-1 | 0.001 | 0.003 |
| Example 2 | A-2 | 0.002 | 0.002 |
| Example 3 | A-3 | 0.002 | 0.002 |
| Example 4 | A-4 | 0.003 | 0.003 |
| Comparative Example 1 | B-1 | 0.052 (poor) | 0.101 (poor) |
| Comparative Example 2 | B-2 | 0.034 (poor) | 0.099 (poor) |
| Comparative Example 3 | C-1 | 0.102 (poor) | 0.108 (poor) |
| Comparative Example 4 | C-2 | 0.141 (poor) | 0.155 (poor) |

Each of the toners A-1 to A-4 (namely, the toners respectively according to Examples 1 to 4) had the above-described features (1) and (2). More specifically, in each of the toners of Examples 1 to 4, the shell layer contained the first resin containing at least one repeating unit having an amide group, and the second resin containing at least one repeating unit having a quaternary ammonium cation. Besides, the charge amount $Q_3$ was equal to or larger than the charge amount $Q_{30}$, and was 20 μC/g or more. Furthermore, the arithmetic mean X and the standard deviation Y of the charge amount distribution of the toner satisfied the relationship of "$Y/X \leq 3.5$". In all the toners of Examples 1 to 4, the zeta potential at pH 4 of the toner core was lower than 0 V, and the zeta potential at pH 4 of the toner particle was higher than 0 V. In all the toners of Examples 1 to 4, the ratio of the first resin particles in the shell layer was 0.5% by mass or more and 5.0% by mass or less, and the ratio of the second resin particles in the shell layer was 95.0% by mass or more and 99.5% by mass or less. For example, in the toner of Example 2, the ratio of the first resin particles in the shell layer was 2.2% by mass ($\approx 100 \times 2 \times 0.05/4.6$), and the ratio of the second resin particles in the shell layer was 97.8% by mass ($\approx 100 \times 15 \times 0.30/4.6$) as shown in Table 1. Besides, in the toner of Example 3, the ratio of the first resin particles in the shell layer was 0.6% by mass ($\approx 100 \times 1 \times 0.05/9.05$), and the ratio of the second resin particles in the shell layer was 99.4% by mass ($\approx 100 \times 30 \times 0.30/9.05$) as shown in Table 1. As shown in Table 2, images with high quality (more specifically, with a low fogging density) could be stably formed using the toners of Examples 1 to 4.

As shown in Table 2, each of the toners B-1 and B-2 (namely, the toners of Comparative Examples 1 and 2) had a higher fogging density than the toners of Examples 1 to 4. This is probably because an oppositely charged toner was produced.

As shown in Table 2, each of the toners C-1 and C-2 (namely, the toners of Comparative Examples 3 and 4) had a higher fogging density than the toners of Examples 1 to 4. This is probably because the charge amount distribution of each of the toners of Comparative Examples 3 and 4 was too broad.

What is claimed is:

1. A positively chargeable toner comprising a plurality of toner particles each containing a core, and a shell layer disposed over a surface of the core, wherein the shell layer contains a first resin containing at least one repeating unit having an amide group, and a second resin containing at least one repeating unit having a quaternary ammonium cation, the first resin is a copolymer of styrene, butyl acrylate, and acrylamide at a mass ratio of 9:1:1, the second resin is a copolymer of methyl methacrylate, butyl acrylate, and 2-(methacryloyloxy)ethyl trimethyl ammonium chloride at a mass ratio of 20:7:6, the shell layer contains first resin particles substantially made of the first resin, and second resin particles substantially made of the second resin, and a ratio of the first resin particles in the shell layer is 0.5% by mass or more and 5.0% by mass or less, and a ratio of the second resin particles in the shell layer is 95.0% by mass or more and 99.5% by mass or less.

2. A positively chargeable toner comprising a plurality of toner particles each containing a core, and a shell layer disposed over a surface of the core, wherein the shell layer contains a first resin containing at least one repeating unit having an amide group, and a second resin containing at least one repeating unit having a quaternary ammonium cation, in a case where a first mixture of 100 parts by mass of a standard carrier and 10 parts by mass of the toner is stirred under an environment of a temperature of 23° C. and a humidity of 60% RH using a shaker mixer, the toner attains, in the first mixture, a charge amount $Q_3$ after stirring for 3 minutes and attains a charge amount $Q_{30}$ after stirring for 30 minutes, and both relationships of "$Q_{30} \leq Q_3$" and "20 μC/g$\leq Q_3$" are satisfied, in a case where a second mixture of 100 parts by mass of the standard carrier and 10 parts by mass of the toner having been charged to a saturated charge amount is born on a development roller to measure a charge amount distribution of the toner in the second mixture, an arithmetic mean X and a standard deviation Y of the charge amount distribution satisfy a relationship of "$Y/X \leq 3.5$", the shell layer contains first resin particles substantially made of the first resin, and second resin particles substantially made of the second resin, the first resin is a copolymer of a styrene-based monomer, an acrylic acid alkyl ester monomer, and an acrylamide, and the second resin is a copolymer of a (meth)acryloyl group-containing quaternary ammonium compound monomer, a methacrylic acid alkyl ester monomer containing, in an ester portion thereof, an alkyl group having 1 or 2 carbon atoms, and an acrylic acid alkyl ester monomer containing, in an ester portion thereof, an alkyl group having at least 3 and no greater than 6 carbon atoms.

3. The positively chargeable toner according to claim 1, wherein the first resin and the second resin each are a resin containing merely at least one repeating unit not having a hydroxyl group.

* * * * *